US005096004A

United States Patent [19]

Ide

[11] Patent Number: 5,096,004

[45] Date of Patent: Mar. 17, 1992

[54] HIGH PRESSURE DOWNHOLE PROGRESSIVE CAVITY DRILLING APPARATUS WITH LUBRICATING FLOW RESTRICTOR

[76] Inventor: Russell D. Ide, P.O. Box 744, 641 Arnold Rd., Coventry, R.I. 02816

[21] Appl. No.: 563,182

[22] Filed: Aug. 6, 1990

Related U.S. Application Data

[63] Continuation-in-part of Ser. No. 454,949, Dec. 22, 1989, abandoned.

[51] Int. Cl.[5] ..... E21B 4/02

[52] U.S. Cl. ..... 175/107; 175/320; 418/48; 138/42

[58] Field of Search ..... 175/107, 320, 323; 418/48; 138/43, 43

[56] References Cited

U.S. PATENT DOCUMENTS

| | | | |
|---|---|---|---|
| 1,510,804 | 10/1924 | Sherwood . | |
| 1,733,416 | 10/1929 | Lebesnerois . | |
| 1,877,495 | 9/1932 | Cater . | |
| 1,961,029 | 5/1934 | Benedek | 308/121 |
| 2,397,124 | 3/1946 | Buffington et al. | 308/238 |
| 2,626,780 | 1/1953 | Ortloff | 255/4 |
| 3,456,746 | 7/1969 | Garrison et al. | 175/320 |
| 3,516,718 | 6/1970 | Garrison et al. | 308/230 |
| 3,840,080 | 10/1974 | Berryman | 175/107 |
| 3,857,655 | 12/1974 | Tschirky | 418/48 |
| 3,866,988 | 2/1975 | Striegler | 308/187.1 |
| 3,936,247 | 2/1976 | Tschirky et al. | 418/48 |
| 3,982,859 | 9/1976 | Tschirky et al. | 418/48 |
| 4,080,115 | 3/1978 | Sims et al. | 418/48 |
| 4,084,749 | 4/1978 | Drori | 239/271 |
| 4,246,976 | 1/1981 | McDonald, Jr. | 175/107 |
| 4,329,127 | 5/1982 | Tschirky et al. | 418/48 |
| 4,397,619 | 8/1983 | Alliquander et al. | 418/48 |
| 4,410,054 | 10/1983 | Nagel et al. | 175/107 |
| 4,462,472 | 7/1984 | Beimgraben | 175/320 |
| 4,506,423 | 3/1985 | Nakamura et al. | 29/157 R |
| 4,515,486 | 5/1985 | Ide | 384/117 |
| 4,526,482 | 7/1985 | Ide | 384/117 |
| 4,546,836 | 10/1985 | Dennis et al. | 175/107 |
| 4,593,774 | 6/1986 | Lingafelter | 175/107 |
| 4,632,193 | 12/1986 | Geezy | 175/65 |
| 4,636,151 | 1/1987 | Eppink | 418/48 |
| 4,665,997 | 5/1987 | Maurer et al. | 175/107 |
| 4,676,668 | 6/1987 | Ide | 384/117 |
| 4,679,638 | 7/1987 | Eppink | 175/107 |

*Primary Examiner*—William P. Neuder

*Attorney, Agent, or Firm*—Marks Murase & White

[57] ABSTRACT

A progressive cavity drilling apparatus which includes a drill bit, a drill bit driving shaft have a hollow bore formed therein and a progressive cavity drive train for driving the drilling shaft. A flow restrictor is provided to cause fluid leaving the progressive cavity drive train to enter the interior of the hollow drilling shaft and then to be exited therefrom through nozzles formed in the drill bit. The flow restrictor includes a groove to allow a small amount of fluid to flow in a path winding around the circumference of the flow restrictor and into a bearing assembly located below the flow restrictor. Because the flow path winds around the circumference of the flow restrictor, it is significantly longer than a straight longitudinal flow path. Consequently, the velocity of the high pressure fliud through the flow path is significantly reduced thus minimizing erosion and wear of the flow restrictor. The flow restrictor may also function as a radial support which can obviate the need for separate radial bearing. The radial support may be provided between the helical grooves or in a separate portion of the flow restrictor. The flow restrictor can also have an inner diameter which is eccentrically moveable with respect to the outer diameter of the flow restrictor so as to accommodate shaft movement.

31 Claims, 8 Drawing Sheets

HIGH PRESSURE DOWNHOLE PROGRESSIVE CAVITY DRILLING APPARATUS WITH LUBRICATING FLOW RESTRICTOR

This application is a continuation-in-part of U.S. application Ser. No. 07/454,949 filed Dec. 22, 1989, now abandoned.

FIELD OF THE INVENTION

This invention relates to high pressure progressive cavity downhole drilling apparatus which are driven by high pressure drilling fluid commonly referred to as "mud" and, more particularly, to such apparatus which include a flow restrictor which allows a small amount of the mud to pass to the shaft bearings for lubrication while accommodating the pressure drop across the flow restrictor. The flow restrictor may be in the form of a combined flow restrictor and hydrodynamic radial support for supporting the drill drive shaft of progressive cavity drilling devices within the drill housing. The present invention also relates to flow restrictors which can be used in connection with known radial and thrust bearings.

BACKGROUND OF THE INVENTION

Progressive cavity or Moineau-type downhole motors have been used for many years in the drilling of oil and gas wells. The construction and operation of such devices is exemplified by U.S. Pat. Nos. 2,892,217 to Moineau (1932); 3,840,080 to Berryman (1974); 4,080,115 to Sims et al. (1978); 4,329,127 to Tschirky et al. (1982); 4,632,193 to Geczy (1986); and 4,679,638 to Eppink (1987). These devices have a single shaft in the shape of one or more helices contained within the cavity of a flexibly-lined housing. The generating axis of the helix constitutes the true center of the shaft. This true center of the shaft coincides with its lathe or machine center. The lined cavity is in the shape of two or more helices (one more helix than the shaft) with twice the pitch length of the shaft helix. One of the shaft and the housing is secured to prevent rotation; the part remaining unsecured rolls with respect to the secured part. As used herein, rolling means the normal motion of the unsecured part of the progressive cavity device. In so rolling, the shaft and housing form a series of sealed cavities which are 180° apart. As one cavity increases in volume, its counterpart cavity decreases in volume at exactly the same rate. The sum of the two volumes is therefore constant.

By pumping high pressure drilling fluid or "mud" into the cavity at one end of the progressive cavity device, the rotor can be caused to rotate so as to cause a progression of cavities which eventually allows the fluid to exit the progressive cavity device. As long as there is a significant fluid pressure drop across the progressive cavity device, the rotor will roll within the stator.

The rolling motion of the rotor is actually, quite complex in that it is simultaneously rotating and moving transversely with respect to the stator. One complete rotation of the rotor will result in a movement of the rotor from one side of the stator to the other side and back. The true center of the rotor will, of course, rotate with the rotor. However, the rotation of the true center of the rotor traces a circle progressing in an opposite direction to the direction of the rotor, but with the same speed (i.e., reverse orbit). Thus, the rotor driving motion is simultaneously a rotation, an oscillation and a reverse orbit.

Because of the complex nature of the rotor movement, the progressive cavity device must include a coupling if it is to be used to drive a drilling shaft. Generally, a universal joint coupling is used to convert the complex rotor motion into rotation of the drilling shaft. It is believed that improved results are provided by progressive cavity devices of the type described in applicant's copending application Ser. No. 07/420,019 filed Oct. 11, 1989 entitled "Progressive Cavity Drive Train". In any case, when used to drive a drilling shaft, a progressive cavity drive train must include at least a rotor, a stator and a coupling.

Progressive cavity downhole drilling apparatus also typically include a housing connected to a conventional drill string composed of drilling collars and sections of drill pipe. The housing includes a passageway through which high pressure fluid can be communicated to the inlet of the progressive cavity device. The drill string extends to the surface where it is typically connected to a kelly mounted in the rotary table of a drilling rig.

The rotor is coupled to a rotary drill shaft mounted in and extending from the bottom of the housing. At its lower end, the drill shaft is connected to a drill bit. The weight of the drill string is transmitted to the drill shaft to assist in breaking up hard formations when the drill shaft is rotated. To relieve the otherwise extreme frictional drag between the drill shaft and the housing, bearings are provided between the housing and the drill shaft.

The high pressure drilling fluid or "mud" is pumped through a first passageway down through the drilling string into the progressive cavity drive train. As the drilling fluid is pumped down through the stator, the rotor is rotated, driving the drill bit. The drilling fluid flows past the progressive cavity drive train coupling and is then directed to an interior passage of the drill shaft where it exits through several nozzles in the drill bit, acting to remove debris by carrying it to the surface. The high pressure fluid then flows from the bottom of the hole to the surface through an annular space between the drilling string and the wall of the bore hole.

Since the drilling fluid and its contaminants can be hostile to the function and life of the bearings, it is desirable to eliminate or control the flow of drilling fluid through the bearings. In most progressive cavity devices, seals have been used to direct the drilling fluid into the interior passage of the drill shaft. As indicated above, this is necessary in order to channel the drilling fluid through the drill bit. The provision of flow diverting seals can also eliminate the drilling fluid from the bearings, permitting oil lubrication to extend bearing life. However, there are problems with such designs. One such problem is caused by the fact that there is a tremendous (in the range of 500 p.s.i. to 2,000 p.s.i.) pressure differential across the seal. Moreover, it is necessary to provide a separate source of lubricant for the drilling shaft bearings. The required pressure equalization means and reservoirs complicate design, creating functional problems which increase initial and maintenance costs. Also, effective seals often create torque losses and expensive repairs result when failures occur.

Another approach has been to use the drilling fluid to lubricate the shaft bearings. In such constructions, a flow restrictor is used, instead of a seal, to direct fluid into the interior of the drilling shaft. The flow restrictor diverts most of the fluid into the drilling shaft, but when properly controlled, a small percentage of the drilling fluid is allowed to pass and to lubricate and cool the radial and thrust bearings prior to entering the drill bit. The amount of drilling fluid that passes through the bearings is controlled by the flow restrictor. In the past, the flow restrictor has typically been a separate member. Often, it consisted of a series of close-fitted hardened rings or a mechanical face seal. It has been found that control of drilling fluid flow through the bearings is less expensive to maintain and less subject to catastrophic failure than elimination of flow via seals.

The present inventor has discovered that certain radial bearings which he previously invented also provide a flow restricting function when used to support a drilling shaft. The use of these bearings as combined flow restrictors and radial supports has yielded superior results at far less cost than conventional flow restrictors. These bearings are described in U.S. Pat. Nos. 4,515,486 and 4,526,482. Similar attempts to provide flow restrictors having support functions have been made in other fields. For example, U.S. Pat. No. 3,456,746 to Garrison discloses bearings having a brass support with a rubber or plastic sleeve which is provided with longitudinal grooves extending the length of the bearing.

While constructions such as the present inventor's previous patented bearing construction have been employed as flow restrictors in some applications, problems have arisen in using these bearings in high-flow, high-pressure drop drills which have recently been introduced. The total hydrostatic pressure head in such devices is in the range of 20,000 to 50,000 p.s.i. The pressure drop across the drill bit of one of these new drills may be as high as 1,000 to 2,000 p.s.i. As a result of this large pressure drop across the bearing, the fluid which is allowed to pass through the flow restrictor moves at a tremendous velocity. This high velocity on the order of (100 ft/s) results in turbulent flow which erodes the bearing grooves after only several hours of operation. It is known that the flow velocity through the channels in the flow restrictor is a function of both the length and size of the channels. Thus, in prior lower-pressure applications, large longitudinal grooves in the bearing were able to keep flows in the laminar region. However, in order to accommodate new high pressure drop applications, such bearings would have to be much larger (about 10 times longer) than currently used. This would dramatically increase the cost of manufacture and use.

Finally, it should be noted that journals with helical channels are also known. U.S. Pat. No. 1,733,416 to Lebesherdis teaches a combination bearing and sealing shaft having a helical groove which is externally provided with lubricating fluid. The helical groove is not intended for flow restriction. U.S. Pat. No. 1,961,029 to Benedek discloses a hydrodynamic bearing with a helical groove. Use of this bearing for flow restriction in high pressure environment is neither disclosed nor suggested. Finally., U.S. Pat. No. 2,397,124 to Buffington et al. discusses a hydrodynamic bearing with two opposing broad helical grooves. The use of the bearing for flow restriction was not recognized.

SUMMARY OF THE INVENTION

The present invention obviates the flow restrictor erosion problems experienced heretofore in known high-pressure progressive cavity drilling devices. Specifically, the present invention provides a high pressure progressive cavity drilling apparatus with a flow restrictor capable of withstanding high pressure drops. The drilling apparatus includes a drill bit, a drill bit driving shaft, a progressive cavity drive train, a housing, a thrust bearing, and flow restrictor.

The drill bit has a cutting head and at least one fluid outlet for high pressure fluid. The drill bit driving shaft is connected to the drill bit and has a longitudinal bore extending therethrough in communication with the fluid outlet of the drill bit.

The progressive cavity drive train drives the drill bit driving shaft and comprises a rotor having a true center, a stator and a coupling for coupling a rotor to the drill bit driving shaft. The stator and the rotor each have co-acting helical lobes which are in contact with one another at any transverse section. The stator has one more helical lobe than the rotor such that a plurality of cavities are defined between the rotor and the stator. The rotor is adapted to rotate within the stator such that a true center of the rotor orbits the axis of the stator causing a progression of the cavities in the direction of the axis of the stator.

The housing encloses the progressive cavity drive train and at least a portion of the drill bit driving shaft. A first passageway extends from the surface to a progressive cavity drive train for conducting drilling fluid from a source of high pressure fluid to the progressive cavity drive train. The flow of the fluid through the progressive cavity drive train causes rotation of the rotor and this rotation is transmitted to the drill bit driving shaft via the coupling. A second passageway provides fluid communication between the progressive cavity drive train and the longitudinal bore in the drilling shaft. A thrust bearing assembly occupies the space between the housing and the drill bit driving shaft. A flow restrictor located between the entrance of the longitudinal bore in the drilling shaft and the thrust bearing diverts the high pressure fluid into the second passageway.

In accordance with an important aspect of the present invention, the radial support and flow restricting functions can be provided simultaneously or, they can be provided by distinct portions of the flow restrictor. The radial support portions of the flow restrictor may be designed to function as a hydrodynamic bearing. In one instance, this can be achieved by providing raised shaft support surfaces. These surfaces may be undercut so as to give them increased radial and circumferential flexibility so that they function as a beam mounted support surface.

The flow restrictor comprises an annular body having an inner circumferential surface which surrounds the drilling shaft, an outer circumferential surface received in the housing and a flow restricting surface extending radially between the inner circumferential surface and the outer circumferential surface to significantly restrict fluid flow between the drilling shaft and the housing. The flow restrictor also includes a groove (generally helical and/or spiral) in fluid communication with the flow restricting surface which winds circumferentially around the flow restrictor and may also include a radial support surface for supporting the rotation of the drilling shaft. The helical groove can be formed on the radial support surface so as to allow a small amount of the high pressure fluid to pass the flow restrictor so as to lubricate the thrust bearing. Alternatively, the helical groove and radial support surface may be provided on separate portions of the flow restrictor.

The helical or spiral groove of the flow restrictor significantly extends the flow length over which the pressure drop occurs. Ideally, the maximum velocity in the groove is proportional to the pressure drop and inversely proportional to the length of the groove. Since a helical groove can be many times the length of a longitudinal groove for a given longitudinal bearing length, flow velocities can be substantially reduced, often from the turbulent to the laminar regime. The groove can have any cross sectional size or shape. The size and shape of the groove affects the flow characteristics of fluid flowing in the groove in a known manner.

By virtue of the helical or spiral path of the groove formed in the flow restrictor of the present invention, the length of the groove per unit length of the flow restrictor is dramatically increased in comparison to known longitudinal grooves. Consequently, the velocity of fluid flow within the groove is reduced and the flow restrictor is capable of accommodating greater pressure drops.

Other advantages are obtained when the flow restrictor is provided with a radial shaft support structure. Most notably, such a construction eliminates the need for a separate radial bearing. Such a construction is also inexpensive, reliable, and durable in comparison to radial bearings previously used for progressive cavity drilling and, thus, can significantly reduce drilling downtime. Moreover, this design promotes fluid flow in bearing areas between the grooves, increasing lubrication along the shaft, and further minimizing wear. The present invention also provides flow restriction and lubrication between the drilling shaft and housing during progressive cavity drilling operations.

The flow restrictor of the present invention can be constructed of a metal such as tungsten carbide or elastomeric material such as nitrile. The flow restrictor can be mounted either within a metal support or directly on to the housing of the drilling device. When the flow restrictor is also used as a radial support, it occupies the space between the drill shaft and the support or housing and is oriented about the same longitudinal axis as the shaft.

The present invention also provides increased lubrication of the drilling shaft bearing. Since there is a pressure drop along the length of the winding groove, there is a pressure gradient between axially adjacent groove portions or between adjacent chambers which receive fluid from different portions of the groove. By virtue of this pressure gradient, flow is induced between the flow restrictor and the shaft. This further lubricates the surface and minimizes wear. It is noted that the tighter clearance of the non-grooved regions maintains fluid flow in the laminar regime.

Finally, the drilling apparatus of the present invention may be further improved by using the progressive cavity drive train disclosed in applicants copending application Ser. No. 07/420,019 filed Oct. 11, 1989 and by using the thrust bearing construction described in applicant's U.S. Pat. No. 4,676,668.

BRIEF DESCRIPTION OF THE DRAWINGS

Other objects, features, and advantages of the present invention are hereinafter set forth and explained with reference to the drawings wherein.

DETAILED DESCRIPTION OF THE DRAWINGS

Figure 1:
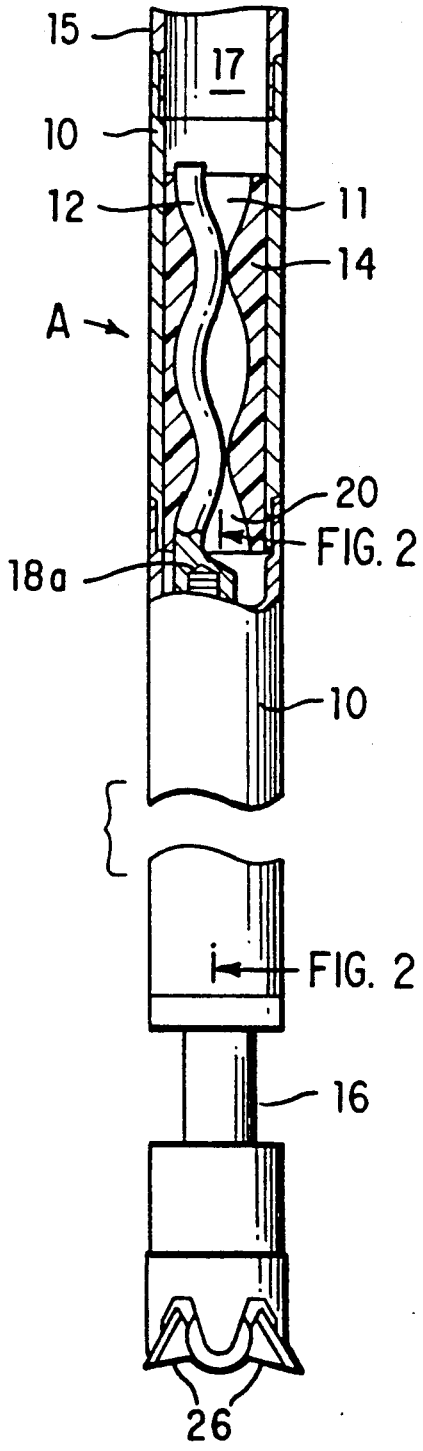
FIG. 1 is an elevation view partly in section of the overall structure of an embodiment of the present invention applied to progressive cavity drilling apparatus.

FIG. 1 illustrates the overall structure of the progressive cavity drilling apparatus of the present invention. The apparatus is intended for use with a source of high pressure drilling fluid (typically water or oil carrying suspended particles commonly referred to as "mud"). The apparatus includes a drill bit 26, a hollow drill shaft 16 located above the drill bit, a progressive cavity drive train A located above the drill shaft, a shaft housing 10 extending from the top of the drilling apparatus to the drill bit, and a coupling 18 having an upper portion shown at 18*a*. It should be understood that in describing the drilling apparatus of the present invention, the terms upper and lower refer to the relative position of the elements of the drilling apparatus in normal usage wherein the drill bit is the lowest element of the elements which make up the drilling apparatus.

As illustrated in FIG. 1, the progressive cavity drive train A includes a motor having a stator, a rotor, a passageway for fluid to enter between the stator and the rotor, and a passageway for the fluid to exit therefrom. In the drawings, the housing 10 and its flexible lining 14 are held against movement so that they function as the stator in the device A and the shaft 12 functions as the rotor. The housing 10 is tubular and is actually the bottom of the drill string, or attached thereto. The housing is typically formed in sections or portions which are connected to one another to form a continuous housing. Each section is hollow and has an inner surface. The housing interior communicates with the inlet 11 in the top portion of the lining 14 to provide a passageway 17 for high pressure fluid to enter the progressive cavity device. Fluid exits through the outlet 20. The shaft 12 is precisely controlled so as to roll within the lining 14. The helical shaft 12 is connected with the upper portion of the coupling 18*a*.

The progressive cavity device is attached to the lower end of a drill string 15 having an interior passageway for allowing the high pressure drilling fluid (mud) to be transported from the surface into the progressive cavity device.

The progressive cavity drive train further includes a coupling for converting the precisely controlled rolling movement of the shaft 12 into rotational movement of the drill drive shaft 16. Conventionally, universal joint couplings are used for this purpose. However, it is believed better results can be achieved by using the progressive cavity device disclosed in copending application Ser. No. 07/420,019 filed Oct. 11, 1989. This progressive cavity device includes a cam coupling which is believed to offer superior performance. There are many other forms of couplings including, for example, gear trains which function as couplings which could be employed. In any case, it is to be understood that the progressive cavity drive train of the drilling apparatus must include some mechanism to convert the complex rotor motion into the driving rotation of the drill shaft, i.e., a coupling.

The housing 10 must be spaced from the coupling portions 18A, 18B so as to provide a passageway or cavity 22 between the coupling and the housing through which drilling fluid may pass. Depending on the nature of the coupling employed, it may be desirable to seal the coupling from the drilling fluid by enclosing the coupling in a rubber boot or the like.

Figure 2B:
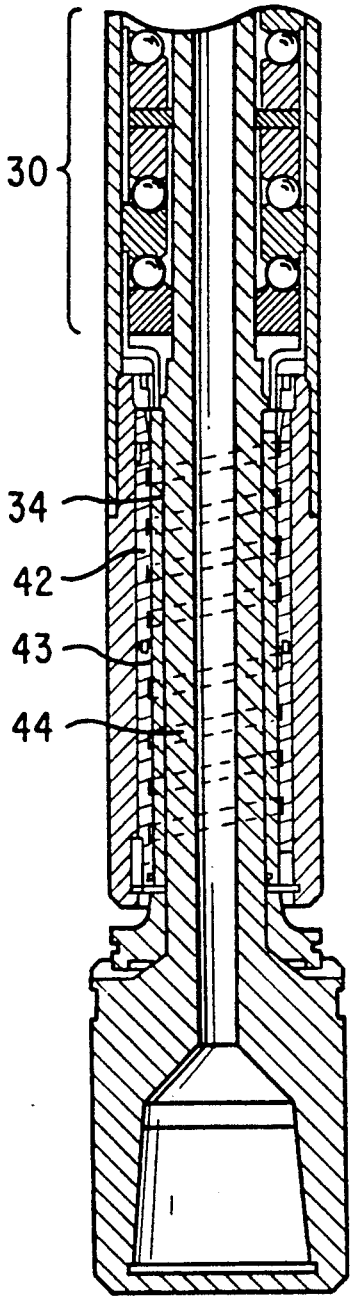
FIGS. 2A–B are sectioned views of a portion of FIG. 1.
Figure 2A:
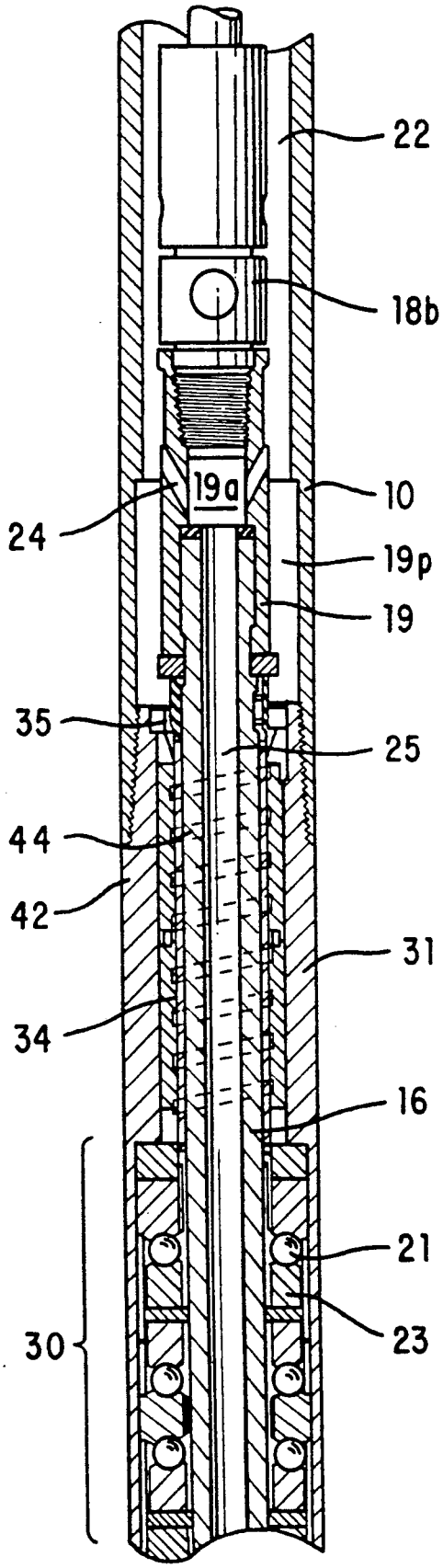

FIGS. 2A and 2B illustrate the lower portion of a first embodiment of the drilling apparatus of the present invention. As illustrated therein, the drilling apparatus employs a universal coupling, the lower portion of which is illustrated at 18B. The lower portion of the coupling 18B is attached, by threading or the like, to the upper end of a drill shaft coupling 19. The lower end of the drill shaft coupling 19 is integral with or, as shown in FIG. 2A, receives the drill shaft 16. As illustrated in FIG. 2A, both the drill shaft coupling 19 and the drill shaft 16 are hollow, i.e., they include longitudinal bores. The longitudinal bore 25 formed in the drill shaft 16 has an upper end which communicates with the interior 19A of the drill shaft coupling 19. The housing 10, may be constructed of tubular sections or portions, such as portion 31. The housing is spaced from elements of the drilling apparatus such as the coupling that there is a fluid passage along the length of the drilling apparatus, through which high pressure drilling fluid may pass.

A plurality of apertures or passages 24 are provided through the drill shaft coupling 19 to allow drilling fluid to pass from the passageway or cavity between the housing 10 and the coupling 18 to the interior 19A of the drill shaft coupling 19.

A first flow restrictor 42 is provided below the apertures or passages 24. The flow restrictor 42 extends between the interior of the shaft housing portion 31 and a sleeve 34 attached to the shaft 16 so as to significantly restrict flow through the passageway between the housing 10 and the drilling shaft 16. The sleeve 34 is attached to the shaft 16 to provide a more smooth surface for contact with the flow restrictor 42 and to provide a replaceable wear resistant surface. Of course, if the drill shaft itself is sufficiently smooth, or if it is determined that increased smoothness is not necessary, the flow restrictor 42 could directly contact the drill shaft 16.

As illustrated in FIG. 2A, the flow restrictor 42 substantially blocks the passage between the portion 31 of the housing 10 and the outermost surface of the shaft, defined by either the sleeve 34 or the shaft 16, causing most of the high pressure fluid to flow through the passages or apertures 24 into the interior of the drill shaft 16. However, in order to allow rotation of the drill shaft 16 and the shaft sleeve 34 (if provided), it is necessary that there be some small clearance between the flow restrictor 42 and the shaft sleeve 34 to allow these elements to move with respect to one another. Additionally, according to the present invention, it is desirable to allow a small amount of drilling fluid to flow past the flow restrictor and lubricate the bearing assembly 30 located below the flow restrictor.

Figure 3:
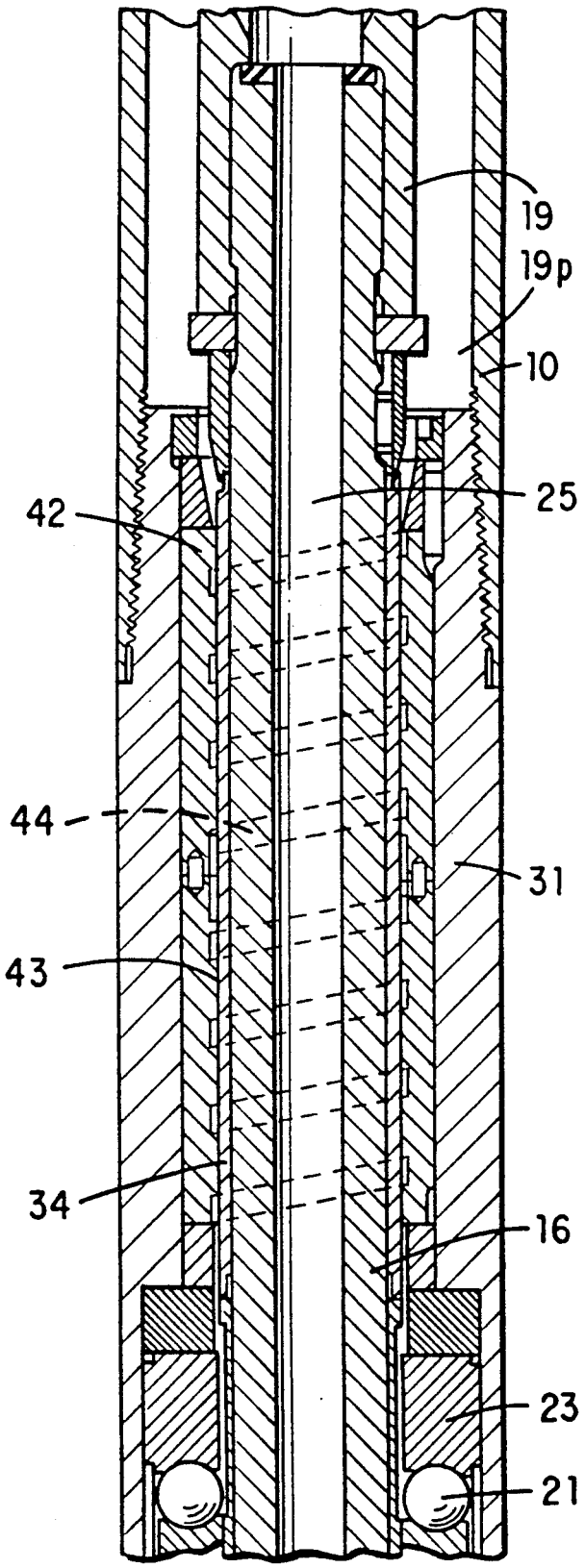
FIG. 3 is a detail view of the flow restrictor used in the first embodiment of the present invention.

In accordance with a first embodiment of the present invention, which is illustrated in FIGS. 2A and 2B and FIG. 3, the flow restrictor 42 is provided with a helical groove 44 on its inner surface (the surface in contact with shaft sleeve 34). The flow restrictor 42 is outwardly tapered at its upper end so as to provide an inlet passage 35 which conducts fluid from the passage 19P between the drill shaft coupling 19 and the housing 10 to the helical groove 44. Thus, while the flow restrictor 42 restricts passage of most fluid to cause fluid to flow through apertures 24 into the interior of the drill shaft 16, a small amount of fluid is allowed to enter passage 35 and flow through the helical groove 44 winding around the circumference of the flow restrictor and entering into the bearing assembly 30.

The flow restrictor 42 of the first embodiment also functions as a radial support for the drill shaft 16. Specifically, the non-grooved or raised portions 43 of the inner surface of the flow restrictor 42 provide a hydrodynamic radial support surface for supporting the drill shaft 16 (preferably via the shaft sleeve 34). In order to provide such hydrodynamic support, it is important that a small film of fluid exist between the raised portions 43 and the portion of the shaft to be supported (34 in the illustrated embodiment). Because the pressure drop across the flow restrictor is evenly distributed across the length of the groove, it follows that there is a pressure gradient between axially adjacent sections of the winding helical groove. As a result of this pressure gradient, some fluid flows across the nongrooved or raised portions. This film of fluid passing across the raised portions 43 provides hydrodynamic support of the shaft 16. Moreover, the provision of the helical groove 44, in addition to allowing a flow of fluid through the flow restrictor 42, also ensures a supply of fluid at axially spaced points along the inner surface of the flow restrictor for maintaining the fluid film across the raised portions 43.

The flow restrictors 42 may be constructed of any suitable material. It is believed that elastomeric materials such as nitrile or metals such as tungsten carbide and silicon carbide are particularly advantageous. The flow restrictor 42 may be provided directly on the interior of the housing or it may have its own housing in the form of a tubular section with an outer diameter sized to fit into the interior of the housing 10.

A bearing assembly is provided between the housing portion 31 and the drill shaft 16. The bearing assembly in the illustrated embodiment includes only a plurality of thrust elements 30. Because the flow restrictor 42 shown in the embodiment of FIG. 2 provides a radial support function, a separate radial bearing is not required. Of course, if additional radial support capacity is desired, separate radial bearings can be provided.

FIGS. 2A and 2B illustrate a conventional thrust bearing arrangement consisting of balls 21 supported in races 23. It is believed that the thrust bearing assembly disclosed in the present inventor's U.S. Pat. No. 4,676,668 provides superior results. However, the drilling apparatus of the present invention can include either form of thrust bearing assembly or any other thrust bearing requiring lubrication.

A second flow restrictor 42 is provided below the bearing assembly 30 to restrict the flow of drilling fluid back into the bearing assembly. In the embodiment illustrated in FIG. 2B, this flow restrictor 42 is constructed identically to the flow restrictor provided above the bearing assembly. Below the second flow restrictor 42, the drill shaft 16 is coupled to a drill bit 26. In the conventional manner, the high pressure drilling fluid flowing through the interior of the drill shaft 16 is communicated with nozzles formed in the drill bit 26 such that the high pressure drilling fluid is discharged through the nozzles to assist in drilling.

Fluid flows through the thrust elements 30 to the helical channel 44 in the lower flow restrictor 42 and is conducted from the helical channel 44 in the lower flow restrictor 42 to the region outside the motor restrictor support housing 31.

Because the flow restrictor 42 restricts flow in the passage between the housing and the shaft, most of the drilling fluid flows from the progressive cavity outlet 20, through the coupling cavity 22 and into the apertures 24 in the drive shaft coupling 15. This fluid then flows through the longitudinal bore 25 of the drill shaft 16 to be jetted through the nozzles of the drill bit 26. This fluid flow assists in removing debris from the drill bit area and carrying it to the surface.

During the drilling operation, an appropriate weight is transmitted from the housings 10, 31 and drill string 15 to the drill bit 26 via the trust bearing assembly 30. Alternately, in the event that the drill bit is removed from the bore hole, the thrust assembly will support the helical shaft 12, coupling 18, 22, drive shaft 16, and drill bits 26 within the housing. The lateral motion of the drilling shaft 16 is supported by the raised portions 43 of the flow restrictor and additional radial bearings, if any, that might be provided.

The helical flow paths within the flow restrictors 42 significantly increases the flow length over which the pressure drop occurs. For example, flow restrictors having a, pitch of one groove per inch and a bearing diameter of five inches will have a groove length 15.7 times that of radial bearings of the same length with longitudinal grooves. Since velocity is directly proportional to groove length, the flow velocity will also be decreased by a factor of 15.7. Thus, for example, a turbulent flow velocity of 150 ft/s would be reduced to a laminar flow velocity of approximately 10 ft/s, eliminating turbulent erosion. Also, since there is a pressure gradient between the grooves along a longitudinal path, flow is induced across the bearing surface, lubricating the surface and further minimizing wear.

Figure 4:
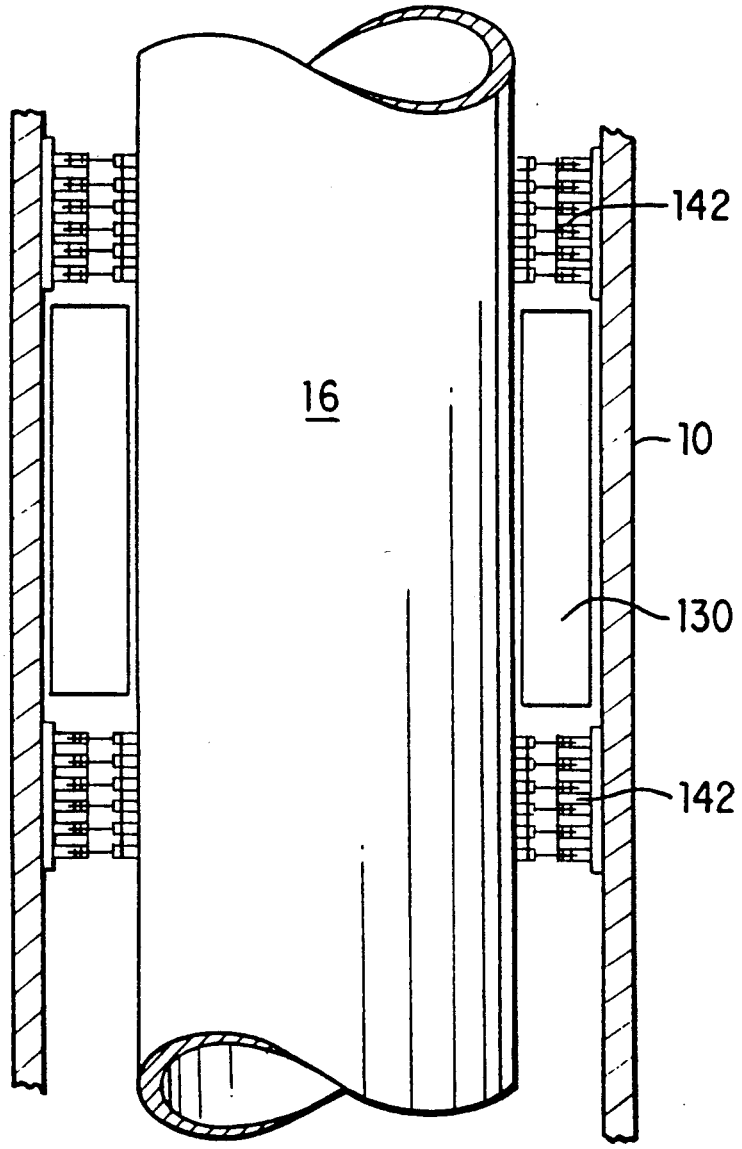
FIG. 4 is an elevation view, partially in section, of another embodiment of the present invention.
Figure 5:
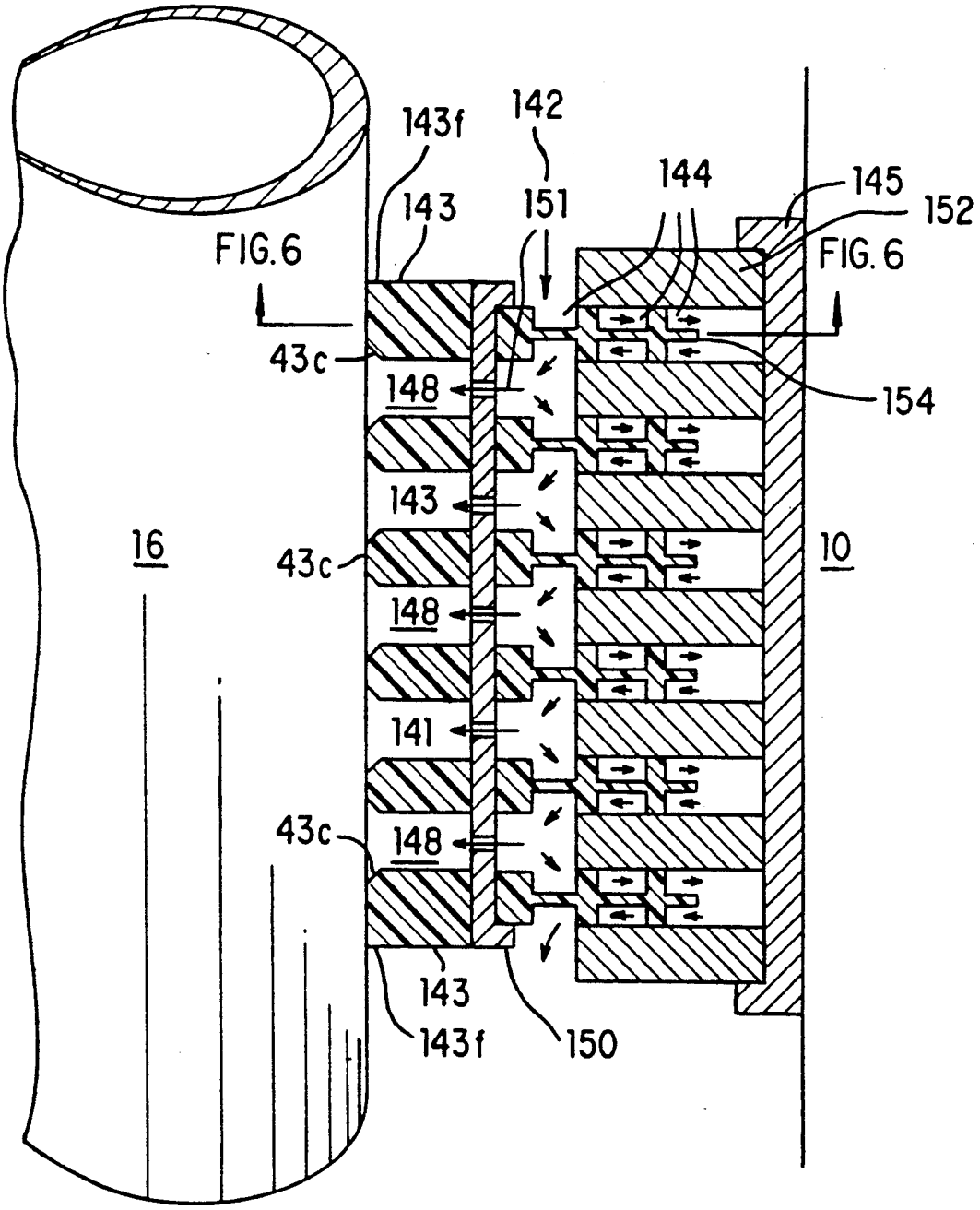
FIG. 5 is a detail view, partially in section, of the flow restrictor employed in the second embodiment of the present invention.
Figure 6:
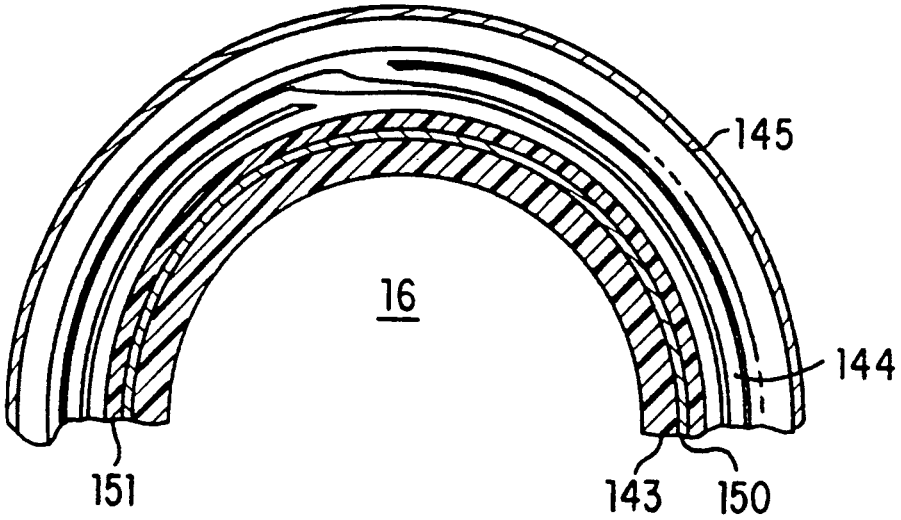
FIG. 6 is a partial axial cross section of the flow restrictor employed in the second embodiment of the present invention.

A second embodiment of the drilling apparatus of the present invention is illustrated in FIGS. 4–6. The second embodiment differs from the first embodiment primarily in the construction of the flow restrictor and bearing assembly. Other elements such as the housing, the progressive cavity drive train, the drill shaft and drill bit can be identical to those disclosed in conjunction with the embodiment illustrated in FIGS. 2 and 3 and are thus not shown in detail.

In FIGS. 4–6, the modified flow restrictor construction is indicated at 142. As discussed below, this flow restrictor construction 142 does not provide sufficient radial support for the shaft to obviate the need for a radial bearing. Consequently, the bearing assembly, indicated generally at 130, must include both radial and thrust bearings.

In FIG. 4, no specific bearing construction is shown since the present invention does not require a specific construction of bearings. The drilling apparatus of the present invention can use conventional ball type radial and thrust bearings or any other known bearings requiring lubrication such as present inventor's deflection pad thrust and radial bearings including those disclosed in any of the aforementioned patents. Regardless of the type of bearing employed, the bearings should be located between the upper and lower flow restrictors 142.

The specific construction of the flow restrictors is shown in greater detail in FIGS. 5 and 6. As shown in these drawings, the flow restrictor 142 includes an outer diameter restrictor housing 145 in secure contact with the shaft housing or casing 10, and a series of elastomeric fingers 143 in contact with the shaft 16. The elastomeric fingers 143 are axially spaced from one another so as to define, in conjunction with the shaft 16 and inner diameter restriction housing 150, a series of spaced annular chambers 148. The elastomeric fingers 143 also have chamfered edges 143C on the sides of the fingers adjacent annular chambers 148. The outer edges of the uppermost and lowermost elastomeric fingers 143 have square edges 143S to prevent entry of drilling fluid or mud. In other words, these flat edges provide a seal between the inner diameter of the flow restrictor and the shaft.

As previously noted, the flow restrictor 142 of the embodiment illustrated in FIGS. 4–6 does not provide a substantial radial support function; it is designed to restrict flow to the amount needed to lubricate the bearing assembly 130. Since the flow restrictor 142 is not intended to act as a radial support, it must accommodate shaft movement. To accommodate shaft movement, the flow restrictor must allow the shaft to slide up and down with respect to the elastomeric fingers in contact with it as well as to rotate on the fingers and move radially with respect to the flow restrictor.

To accommodate such movement, the flow restrictor 142 includes, in addition to the elastomeric fingers 143 and the outer diameter restrictor housing 145, an inner diameter restrictor housing 150 and an assembly of interleaved flat outer diameter washers or discs 152 and inner diameter washers or discs 154. The inner diameter washers or discs 154 are provided with a spiral groove or channel 144 on at least one face (in the illustrated embodiment, grooves are provided on both faces). The inner diameter and outer diameter washers or discs may be formed of any suitable material. For example, metal, rubber or a composite such as rubber on metal can be used.

As shown particularly well in FIG. 5, the interleaved flat washers 152 and groove washers 154 provide a tortuous fluid flow path which winds around the circumference of the flow restrictor. The flow path is indicated by the arrows in FIG. 5. As is apparent from FIGS. 5 and 6, the flow path includes portions which are radially aligned such that the flow path includes more than one segment in the same axial plane.

The inner diameter restrictor housing 150 includes a plurality of flow holes 151 which communicate the spaced series of chambers 148 with various points along the tortuous flow path defined by the interleaved discs 152 and spiral washers 154. As discussed above, the pressure differential between the inlet and outlet of the flow restrictor is distributed across the entire flow restrictor. Since the flow holes 151 are provided at spaced points along the tortuous path defined by the helical grooves 144, the pressure in the chairs 148 fed by these flow holes is progressively less. In other words, the pressure of the fluid in the chamber 148 closest to the inlet of the flow restrictor is greater than the pressure of the fluid in the next chamber 148 which in turn is greater than the pressure in the next chamber 148. Thus, there is a pressure gradient across each of the surfaces of the rubber fingers 143 which are in contact with the shaft. This ensures that a small flow of fluid is induced across the surfaces to lubricate the surfaces and minimize wear of the rubber fingers.

It should also be noted that the washers 154 having the spiral grooves formed on each face are slidably interleaved between the flat washers 152. Thus, the inner diameter of the flow restrictor is movable with respect to the outer diameter so that the flow restrictor can accommodate some eccentricity (radial movement) of the shaft 16.

FIG. 6 shows a cross section of the flow restrictor assembly. As shown therein, the groove need not be, strictly speaking, a spiral. It is only necessary that the groove provide a plurality of circumferential paths which wind around the circumference of the flow restrictor so as to force fluid entering the flow restrictor to travel a relatively great distance per unit length. In the illustrated embodiment, the fluid must circle the shaft twice to pass each face of each washer 154. Consequently, in order to pass the six washers shown in the flow restrictor illustrated in FIG. 5, the fluid must circle the shaft twenty-four times between the inlet and outlet. Thus, it is easily seen that the flow restrictor 142 provides a flow path having a length which is substantially increased over the fluid path of known flow restrictors and consequently a flow restrictor which is capable of accommodating a much greater pressure drop.

The second embodiment of the present invention works in much the same way as the first embodiment described above. Specifically, high pressure drilling fluid or mud passes from a source of such fluid through the housing 10 into and through the progressive cavity drive train causing rotation of the drill shaft. The upper flow restrictor 142 causes the high pressure fluid to primarily flow through apertures 24 in the drill shaft 16 or drill coupling 19 into the bore 25 formed in the drill shaft and ultimately through the nozzles formed in the drill bit 26. Like the first embodiment, the flow restrictor 142 allows a small amount of fluid to flow into the bearing assembly 130, which, in this case, includes both radial and thrust bearings, and then subsequently through the lower flow restrictor 142 into the interior of the housing. Like the helical flow path 44 provided in the flow restrictor 42 of the first embodiment, the spiral flow path 144 provided in the flow restrictor 142 significantly increase the flow length over which the pressure drop across the flow restrictor occurs. Again, flow velocity is decreased as a direct proportion to groove length; thus, the velocity of flow through the flow restrictor is greatly decreased.

Figure 7:
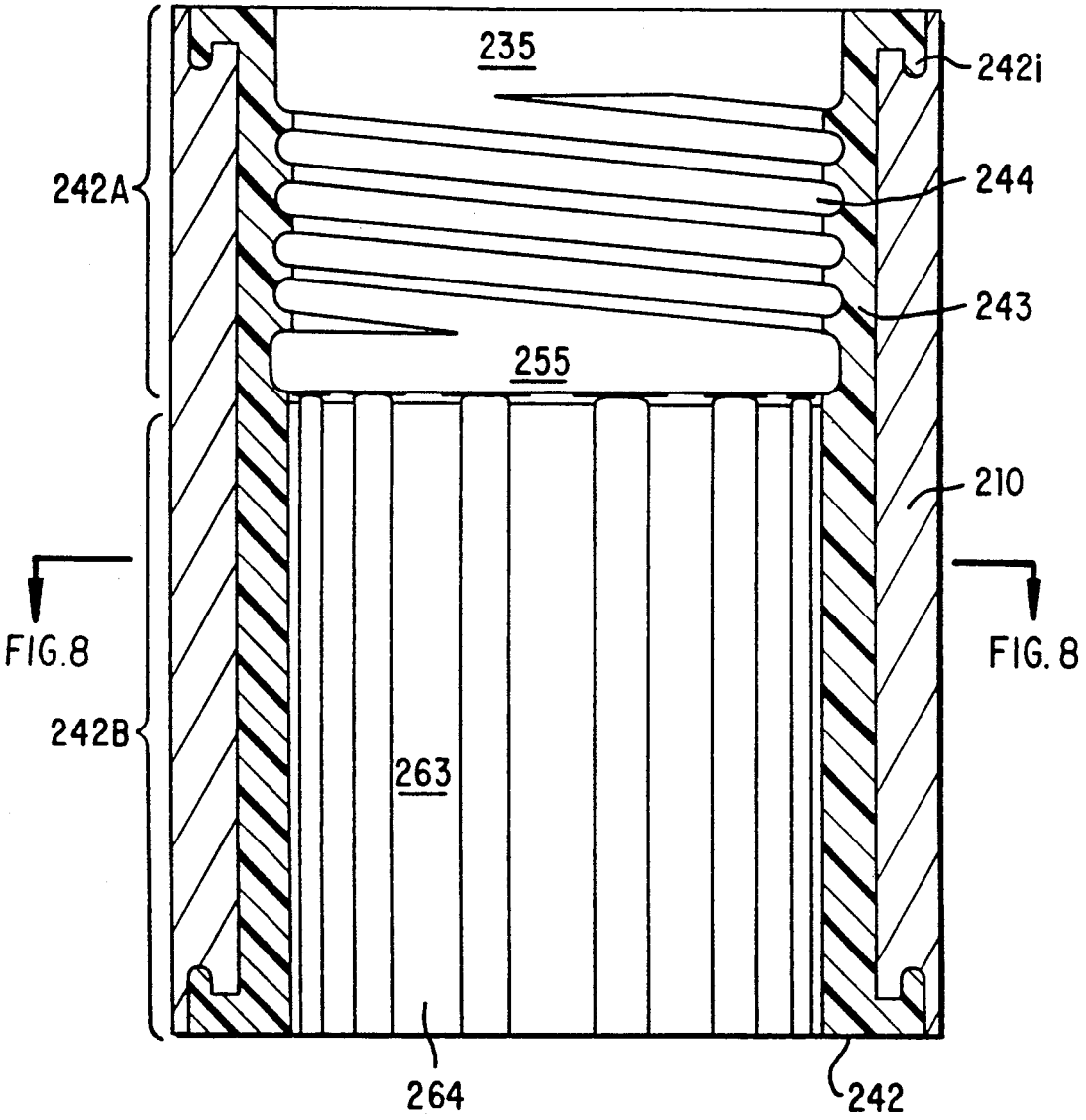
FIG. 7 is a cross sectional elevation view of another embodiment of the present invention.
Figure 8:
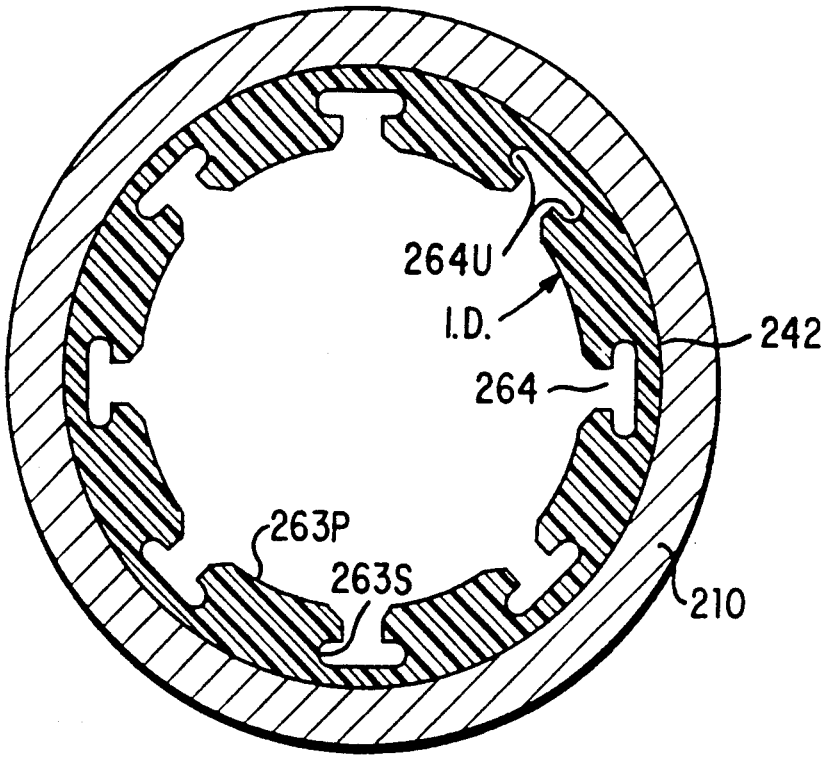
FIG. 8 is an axial cross-section of the flow restrictor of FIG. 7 along the lines indicated in FIG. 7.

A third embodiment of the drilling apparatus of the present invention is illustrated in FIGS. 7–8. The third embodiment differs from the first embodiment only in the construction of the flow restrictor. Other elements such as the housing, the progressive cavity drive train, the bearing assembly, the drill shaft and drill bit can be identical to those disclosed in conjunction with the embodiment illustrated in FIGS. 2 and 3 and are thus not illustrated.

As shown in FIGS. 7–8, the flow restrictor of the third embodiment is different than the flow restrictor of the first embodiment in that the flow restrictor includes two distinct portions, the first for performing a flow restricting function and the second for performing the radial support function. Thus, as shown in FIG. 7, the flow restrictor includes a flow restricting portion 242A and a radial support portion 242B. The two portions are preferably formed from the same material, preferably elastomeric, which can be mechanically interlocked with a rigid housing by mechanical interlocks 242*i*.

The flow restricting portion 242A includes a helical groove 244 on its inner surface (the surface in contact with the shaft sleeve). The flow restrictor further includes an inlet passage 235 for conducting fluid from the passage 19P between the drill shaft coupling 19 and the housing 10 to the helical groove 244. Although not shown as such, the inlet passage 235 could be outwardly tapered to assist in conducting the fluid. Thus, it can be seen that the flow restricting portion 242A of the flow restrictor 242 shown in FIG. 7 is quite similar to the flow restrictor shown in FIGS. 2 and 3. The major difference is that the non-grooved or raised portions 243 of the inner surface of the flow restrictor 242 are proportionately much thinner than the corresponding portions 43 of the embodiment of FIGS. 2 and 3. The thin walls 243 of the flow restrictor shown in FIG. 7 have no significant radial load bearing ability. Consequently, these thin walls 243 deflect under high loads to allow fluid passage.

The radial support portion 242B of the flow restrictor 242 is defined by a plurality of axially extending grooves 264 which define a plurality of spaced non-grooved or raised portions 263. The non-grooved or raised portions 263 of the inner surface of the radial support portion 242B provide a hydrodynamic radial support surface for supporting the drill shaft. As best shown in FIG. 8, the radial support portion has been machined to the precise inner diameter I.D. required. As with any hydrodynamic bearing, the inner diameter of the radial support portion is a predetermined small amount larger than the outer diameter of the shaft which is to be supported so as to allow a fluid film which supports the shaft. In accordance with an important aspect of the present invention, the raised surfaces 263 can be undercut so as to function like a beam mounted support pad. Specifically, as best shown in FIG. 8, the axial groove 264 can be provided with tangential or circumferential groove extensions 264U to undercut the raised surfaces 263.

The axial groove 264 and the tangential or circumferential grooves 264U together define a pad support structure which has the appearance of a continuous ring having a plurality of equally spaced pedestals extending radially inward. In this way, the provision of the tangential or circumferential grooves 264U results in a cantilever-type support for the raised surfaces 263 are divided into a pad portion 263P and a support portion 263S. The undercut support portion 263S is capable of deflection in the circumferential direction relatively easily. In the embodiment shown in FIG. 8, the skeletal support portion forms a radially rigid pad support portions such that the radial support bearing is not too easily compressed in the radial direction.

When the radial support illustrated in FIGS. 7 and 8 is provided with inner axial grooves 264 and tangential or circumferential grooves 264U as illustrated in FIG. 8, the circumferentially spaced support portions 263 and the continuous ring of elastomer on which they are supported functions as a network of beams adapted to deflect under load. Specifically, the radial support portion 242B shown in FIG. 8, includes eight pedestal-like support sectors 263S. The pad portion 263P functions as a circumferential beam supported on a radially extending pedestal-type beam defined by the support portion 263S. The continuous elastomeric section functions as an interconnected series of tangential or circumferential outer beams. Under load, this network of beams deflects in a manner which is determinable based upon the degree of load, the type of material used in the support structure and the size and spacing of the groove 264 and 264U.

Preferably, the flow restrictor lining 242 is constructed of non-Newtonian fluidic material such as rubber. Consequently, the pad and support sections 263P and 263S tend to flow in a determinable manner under load. In a typical usage situation, the radial support is subject to both radial loads resulting from the weight of the shaft and shear loads resulting from the rotation of the shaft. Since the radial support is restrained in the radial direction by the housing 210 in normal usage, the fluidic materials of which the radial support is constructed are nearly incompressible in the radial direction. However, this is true only to the extent the non-Newtonian fluidic material of the support is restrained by the housing in the radial direction. Thus, those portions of the pad section 263P which are undercut are not restrained by the housing in the radial direction. Accordingly, these portions are subject to radial deflection which can result in the flow of non-Newtonian fluidic material.

The portions of the radial support which are entirely restrained in the radial direction by the housing 210, are nearly incompressible in the radial direction and radial load is absorbed by the fluid film between the raised surfaces 263B and the rotating shaft. On the other hand, by virtue of the inner axial groove 264 and the circumferential extensions thereof 264U, neither the raised surface portions 263P nor the supports 263S are restrained from circumferential deflection in response to shear load applied by the rotating shaft. Moreover, because of the undercuts 264U, the circumferential ends of the beam-like portions 263P are not supported in the radial direction. Also, as discussed above, there is a small gap between the shaft and the radially innermost surface of the raised portions 263P. Because of this gap and the fact that the radial support portion is constructed of non-Newtonian fluidic material, the entire support surface 263P and the associated segment of the support 263S can swing upward in response to the shear load applied by the rotating shaft to form a hydrodynamic wedge. Ideally, the surface portions 263P and the support 263S deflect so as to form a wedge across the entire circumferential face of the support face 263P. When a wedge is created across the entire face of the surface 263P, optimum results are achieved because the greatest possible hydrodynamic advantage is generated. It must be stressed that the actual deflections needed and achieved are quite small.

In this way, it can be seen that the flow restrictor shown in FIGS. 7–8 provides the ability to provide complete radial support for the drill shaft.

As mentioned earlier, the flow restricting portion 242A works in much the same way as the first embodiment described above. Specifically, high pressure drilling fluid or mud passes from a source of such fluid through the housing 10 into and through the progressive cavity drive frame causing rotation of the drill shaft. As with the embodiment of FIGS. 2 and 3, the upper flow restrictor 242 causes the high pressure fluid to primarily flow through apertures 24 in the drill shaft or drill coupling 19 into the bore 25 formed in the drill shaft and ultimately through the nozzles formed in the drill bit 26. However, like the first embodiment, the flow restrictor 242 allows a small amount of fluid to flow into the bearing assembly, which in this case, includes only thrust bearings, the radial support being provided by the radial support portion 242B of the flow restrictor. Fluid then flows through the lower flow restrictor 242 into the interior of the housing. Like the helical path 44 provided in the flow restrictor 42 of the first embodiment, the helical flow path 244 provided in the flow restricting portion 242A of the flow restrictor significantly increases the flow length over which the pressure drop across the flow restrictor occurs. Again, flow velocity is increased as a direct proportion to groove length; thus, the velocity of flow through the flow restrictor is greatly decreased.

What is claimed is:

1. A progressive cavity drilling apparatus for use with a source of high pressure fluid, the drilling apparatus comprising:

a drill bit having a cutting head and at least one fluid outlet for the high pressure fluid;

a drill bit driving shaft connected to the drill bit, the drill bit driving shaft having a longitudinal bore extending therethrough and in fluid communication with the fluid outlet of the drill bit;

a progressive cavity drive train for driving the drill bit driving shaft, the progressive cavity drive train comprising a rotor having a true center, a stator and a coupling for coupling the rotor to the drill bit driving shaft, the stator and rotor each having co-acting helical lobes which are in contact with each at any transverse section, the stator having one more helical lobe than the rotor such that a plurality of cavities are defined between the rotor and the stator, the rotor being adapted to rotate within the stator such that the true center of the rotor orbits the axis of the stator, the orbit causing a progression of cavities in the direction of the axis of the stator;

a housing, the housing enclosing the progressive cavity drive train and at least a portion of the drill bit driving shaft;

a first passageway extending to the progressive cavity drive train for conducting a drilling fluid from the source of high pressure fluid to the progressive cavity drive train, the flow of fluid through the progressive cavity drive train causing rotation of the rotor, the rotation of the rotor being transmitted to the drill bit driving shaft via the coupling;

at least one second passageway providing fluid communication between the progressive cavity drive train and the longitudinal bore in the drilling shaft;

a bearing assembly between the housing and the drill bit driving shaft; and a flow restrictor located proximate said second passageway between the progressive cavity drive train and the bearing assembly for diverting the high pressure fluid into the second passageway, the flow restrictor having a groove formed therein for conducting fluid through the flow restrictor, the groove providing a fluid flow path which winds around the circumference of the flow restrictor so that the length of the flow groove is increased.

2. The progressive cavity drilling apparatus of claim 1 wherein the groove follows a substantially helical path within the flow restrictor.

3. The progressive cavity drilling apparatus of claim 1 wherein the flow path within the flow restrictor is at least partially radial aligned such that the flow path includes more than one segment in the same axial plane.

4. The progressive cavity drilling apparatus of claim 1 wherein the inner diameter of the flow restrictor is eccentrically movable relative to the outer diameter of the flow restrictor to accommodate shaft movement.

5. The progressive cavity drilling apparatus of claim 1 wherein the flow restrictor further includes a plurality of axially spaced annular fluid chambers separated from one another by a plurality of annular radial fingers and wherein each of the annular fluid chambers is in communication with a portion of the flow path such that there is a pressure gradient across each of the annular radial fingers.

6. The progressive cavity drilling apparatus of claim 1, further comprising a sleeve mounted on the drilling shaft such that the inner diameter of the flow restrictor contacts the sleeve.

7. The progressive cavity drilling apparatus of claim 1, wherein the flow path winds around the circumference of the flow restrictor at least twice.

8. The drilling apparatus of claim 1, wherein the flow restrictor further comprises a radial support for supporting the rotating drill bit driving shaft for rotation within the flow restrictor, the radial support being defined by a plurality of spaced grooves formed in the inner surface of the flow restrictor, the radially innermost surfaces of the spaces between said grooves providing the radial support.

9. The drilling apparatus of claim 8, wherein the grooves defining the radial supports include circumferential extensions which undercut the radially innermost surface of the radial supports thereby providing a pedestal-like support structure for the support surfaces.

10. The drilling apparatus of claim 9, wherein the helical grooves and the radial support are axially spaced from one another and the radial support is located downstream of the helical grooves such that fluid flows through the helical grooves before passing through the radial support.

11. A progressive cavity drilling apparatus for use with a source of high pressure fluid, the drilling apparatus comprising:

a drill bit having a cutting head and at least one fluid outlet for the high pressure fluid;

a drill bit driving shaft connected to the drill bit, the drill bit driving shaft having a longitudinal bore extending therethrough and in fluid communication with the fluid outlet of the drill bit;

a progressive cavity drive train for driving the drill bit driving shaft, the progressive cavity drive train comprising a rotor having a true center, a stator and a coupling for coupling the rotor to the drill bit driving shaft, the stator and rotor each having co-acting helical lobes which are in contact with one another at any transverse section, the stator having one more helical lobe than the rotor such that a plurality of cavities are defined between the rotor and the stator, and the rotor being adapted to rotate within the stator such that the true center of the rotor orbits the axis of the stator, the orbit causing a progression of cavities in the direction of the axis of the stator;

a housing, the housing enclosing the progressive cavity drive train and at least a portion of the drill bit driving shaft;

a first passageway extending to the progressive cavity drive train for conducting a drilling fluid from a source of high pressure fluid to the progressive cavity drive train, the flow of the fluid through the progressive cavity drive train causing rotation of the rotor, the rotation of the rotor being transmitted to the drill bit driving shaft via the coupling;

at least one second passageway providing fluid communication between the progressive cavity drive train and the longitudinal bore in the drilling shaft;

a thrust bearing between the housing and the drill bit driving shaft; and a flow restrictor located proximate said second passageway between the progressive cavity drive train and the thrust bearing for diverting the high pressure fluid into the second passageway, the flow restrictor including a radial support surface for supporting the drilling shaft for rotation, the flow restrictor having a helical groove formed therein to allow some of the high pressure fluid to pass the flow restrictor so as to lubricate the thrust bearing.

12. The progressive cavity drilling apparatus of claim 11, wherein said radial support member is composed of an elastomeric material.

13. The progressive cavity drilling apparatus of claim 11, wherein the radial support member is composed of tungsten carbide.

14. The progressive cavity drilling apparatus of claim 11, the radial support being defined by a plurality of spaced grooves formed in the inner surface of the flow restrictor, the radially innermost surface of the spaces between said grooves providing the radial support.

15. The progressive cavity drilling apparatus of claim 14, wherein the grooves defining the radial supports include circumferential extensions which undercut radially innermost surface of the radial supports thereby providing a pedestal-like support structure for the support surfaces.

16. The progressive cavity drilling apparatus of claim 15, wherein the helical grooves and the radial support are axially spaced from one another and the radial support is located downstream of the helical grooves such that fluid flows through the helical grooves before passing through the radial support.

17. The progressive cavity drilling apparatus of claim 11, further comprising a rigid sleeve in which the flow restrictor is mounted, the rigid sleeve being mounted in the housing.

18. The progressive cavity drilling apparatus of claim 11, wherein said flow restrictor is mounted in the drill housing.

19. In combination with a downhole drilling apparatus which includes a rotatable drill bit drive shaft for driving a drill bit and a drive shaft housing spaced from and surrounding the drive shaft so as to provide a fluid passageway between the shaft and the housing, a flow restrictor for restricting flow in the passageway between the housing and the rotatable shaft, the flow restrictor comprising:

an annular body having a circumferential inner surface;

a circumferential outer surface and a flow restricting surface extending between the inner surface and the outer surface; and a groove in fluid communication with the flow restricting surface for conducting fluid through the flow restrictor, the groove providing a fluid flow path which winds around the circumference of the flow restrictor so that the length of the flow groove is increased thereby increasing the distance over which a pressure drop across the flow restrictor occurs to reduce the velocity of fluid flow through the flow restrictor.

20. The flow restrictor of claim 19, wherein the groove follows a substantially helical path within the flow restrictor.

21. The flow restrictor of claim 19, wherein the flow path within the flow restrictor is at least partially radial aligned such that the flow path includes more than one segment in the same axial plane.

22. The flow restrictor of claim 19, wherein the inner diameter of the flow restrictor is eccentrically movable relative to the outer diameter of the flow restrictor to accommodate shaft movement.

23. The flow restrictor of claim 19, wherein the flow restrictor further includes a plurality of axially spaced annular fluid chambers separated from one each of the annular fluid chambers is in communication with a portion of the flow path such that there is a pressure gradient across each of the annular radial fingers.

24. The flow restrictor of claim 19, further comprising a sleeve mounted on the drilling shaft such that the inner diameter of the flow restrictor contacts the sleeve.

25. The flow restrictor of claim 19, wherein the flow path winds around the circumference of the flow restrictor at least twice.

26. The flow restrictor of claim 19, wherein the flow restrictor further comprises a radial support for supporting a rotating shaft for rotation within the flow restrictor, the radial support being defined by a plurality of spaced grooves formed in the inner surface of the flow restrictor, the radially innermost surfaces of the spaces between said grooves providing the radial support.

27. The flow restrictor of claim 24, wherein the grooves defining the radial supports include circumferential extensions which undercut the radially innermost surface of the radial supports thereby providing a pedestal-like support structure for the support surfaces.

28. The flow restrictor of claim 25, wherein the helical grooves and the radial support are axially spaced from one another and the radial support is located downstream of the helical grooves such that fluid flows through the helical grooves before passing through the radial support.

29. The progressive cavity drilling apparatus of claim 1, wherein the flow restrictor includes at least a portion formed of rubber and the groove is formed in said rubber portion.

30. The progressive cavity drilling apparatus of claim 11, wherein the radial support surface is formed of rubber.

31. The flow restrictor of claim 19, wherein the flow restricting surface is formed of rubber.

* * * * *